United States Patent [19]

Ahroni

[11] Patent Number: 4,631,650

[45] Date of Patent: Dec. 23, 1986

[54] SERIES-PARALLEL CONNECTED MINIATURE LIGHT SET

[76] Inventor: Joseph M. Ahroni, 2701 W. Manor Pl., #204, Seattle, Wash. 98199

[21] Appl. No.: 664,153

[22] Filed: Oct. 24, 1984

[51] Int. Cl.[4] ..... F21V 19/00

[52] U.S. Cl. ..... 362/249; 174/114 R; 174/117 F; 313/1; 313/51; 315/288; 339/97 L; 362/806

[58] Field of Search ..... 362/227, 234, 237, 238, 362/249, 252, 806; 339/96, 97 R, 97 L, 157 C, 174; 174/113 R, 114 R, 114 S, 117 F; 315/288; 313/250, 251, 272, 269, 268, 285, 1, 51

[56] References Cited

U.S. PATENT DOCUMENTS

| | | | |
|---|---|---|---|
| 1,974,472 | 9/1934 | Seghers | 362/249 |
| 2,506,620 | 5/1950 | Sundt | 362/249 |
| 2,802,083 | 8/1957 | Lapeyre | 339/97 R |
| 3,214,579 | 10/1965 | Pacini | 362/227 |
| 3,551,723 | 12/1970 | Van Groningen | 362/227 |
| 3,609,643 | 9/1971 | Connan | 339/97 L |
| 3,708,608 | 1/1973 | Wyman | 339/96 |
| 3,867,621 | 2/1975 | Gewfrtz et al. | 339/97 L |
| 3,873,885 | 3/1975 | Elfverson | 339/96 |
| 4,197,154 | 4/1980 | Pfaff, Jr. | 174/117 F |

*Primary Examiner*—William A. Cuchlinski, Jr.
*Attorney, Agent, or Firm*—Seed and Berry

[57] ABSTRACT

A series-parallel lighting string having a cord with three wires separated by insulation and a series of cutouts severing the center wire of the cord, and lampholders positioned at each of the cutouts to hold a miniature push-in type light bulb. Each of the lampholders has a pair of contact plates between which a bulb is inserted with its lead wires in contact with the plates. The contact plates are positioned within a husk of the lampholder, and the husk has a snap-fitting cap hingedly attached thereto to define a wireway. The wireway is formed by corresponding semicircular grooves in each of the husk and the cap sized to receive the cord. Each of the contact plates has an insulation-piercing contact finger positioned to engage one of the end portions of the severed wire to each side of the cutout in the cord. The first and last lampholders in each series set has a second cord-piercing contact finger which contacts one or the other of the outer non-severed wires. The cap has an insulating divider which projects through the cutout to keep the severed end portions of the central wire separated. The center contact fingers of the pair of contact plates for a lampholder bridge the cutout. For the first and last lampholders, the other contact finger of the outer plate makes contact with one of the non-severed wires to provide a plurality of series sets of lampholders connected in parallel.

21 Claims, 11 Drawing Figures

FIG. 4
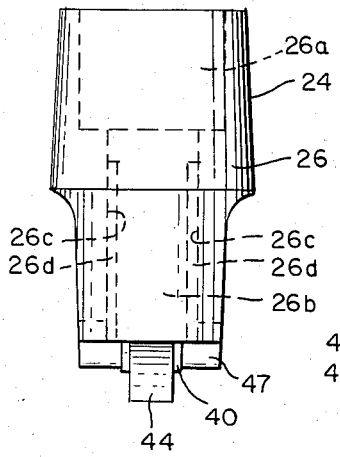
FIG. 5
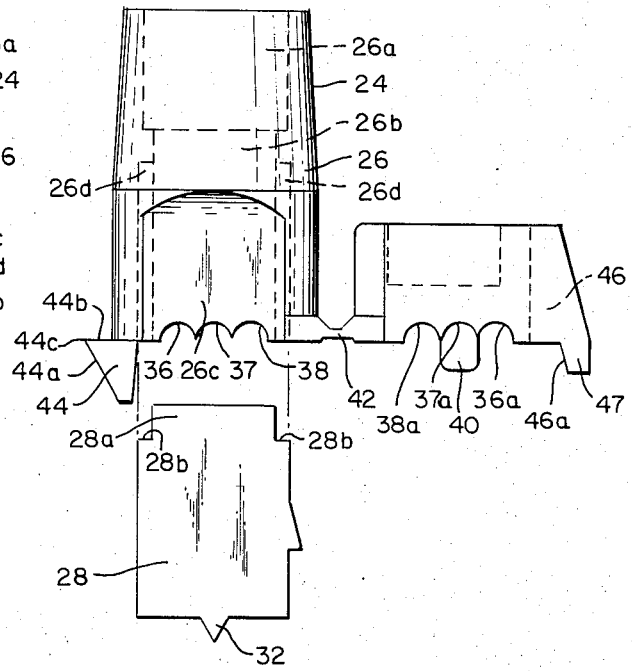
FIG. 6
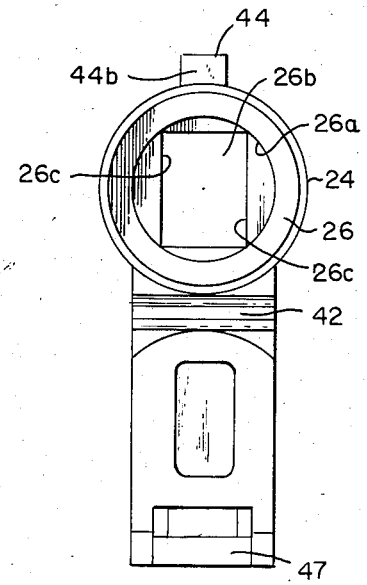
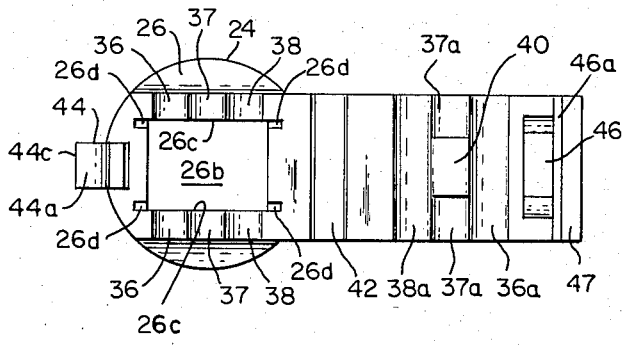
FIG. 7

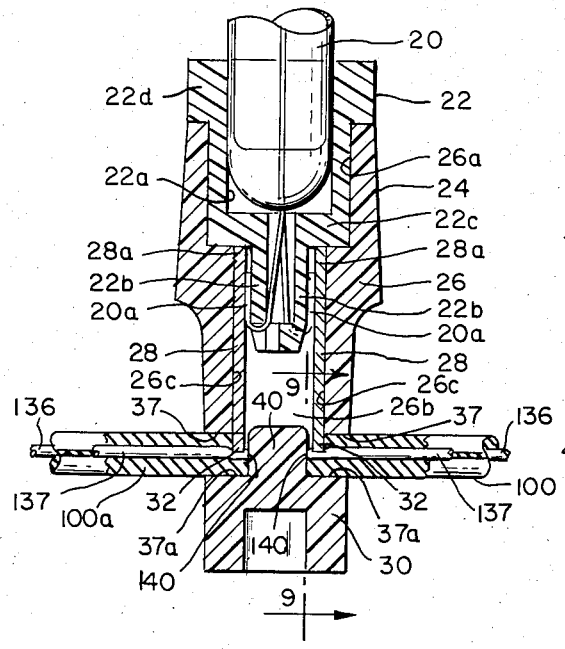
FIG. 8
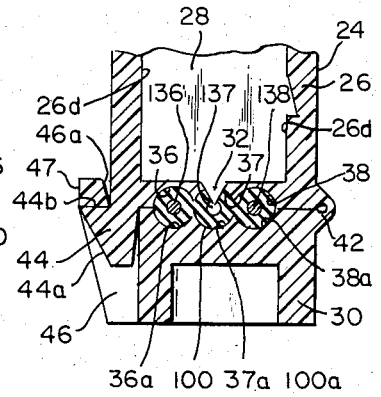
FIG. 9
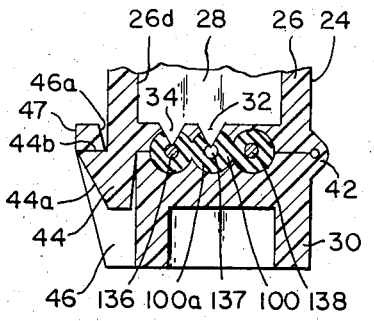
FIG. 10
FIG. 11
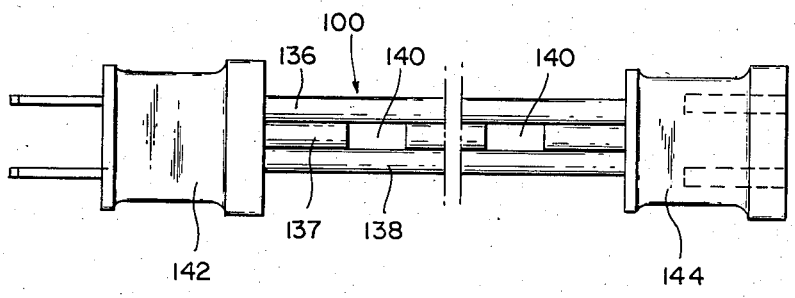

SERIES-PARALLEL CONNECTED MINIATURE LIGHT SET

DESCRIPTION

1. Technical Field

The present invention relates to series-parallel strings of lights, and particularly to those having miniature push-in type bulbs operating at relatively low voltage.

2. Background Art

Decorative light strings in which all of the bulbs are in a single series has the disadvantage that if one bulb fails to light, the entire string goes out and it may be difficult to determine which light failed. Also, in a series string, the voltage available for each light is the line voltage divided by the number of bulbs. If, on the other hand, all the bulbs are in a parallel arrangement, failure of one of the bulbs does not affect the others, but each bulb is subjected to the full line voltage unless a transformer is used.

A suitable compromise between a series lighting circuit and a parallel lighting circuit is one in which sets of series-arranged bulbs are wired in parallel relation to make up a string. This is called a "series-parallel" string. In such a string, the voltage for each light is the line voltage divided by the number of bulbs in each set. If a bulb fails in a series-parallel string, only the bulbs in the series set containing that bulb will fail to light. Hence, there are less bulbs to check to find the faulty bulb than in a string where all the bulbs are in a single series string.

Normally, in a series-parallel string of miniature push-in type bulbs, the lampholders in each series set are interconnected by using multiple short lengths of insulated lead wire connected to contact plates in a manner similar to that shown, for example, in U.S. Pat. No. 3,104,924. The lead wires to and from the first and last lampholders in each series set are connected, respectively, to parallel wires from the wall plug. Alternatively, the connection to the parallel wires is made by interrupting the parallel wires at the first and last bulbs of each series set and connecting both interrupted ends to the appropriate contact plate of the first and last lampholders. Hence, assembly of a series-parallel string of miniature lights has involved the handling and end-stripping of many pieces of wire, and normally there has been a need to wind the series wires and the parallel wires together between the bulbs for ease of handling when applying the string to a Christmas tree.

DISCLOSURE OF INVENTION

The present invention provides an improved lampholder and insulated three-strand cord, making it unnecessary to use multiple short lengths of wire, thus making it faster to assemble a string and easier to apply it to a Christmas tree.

In carrying out the invention, lampholders are provided with a snap-on cover at their base end which swings into a closed position and provides a wireway with the rest of the lampholder housing. Two contact plates in each lampholder have pointed contact fingers projecting into the wireway to pierce the insulation of the cord to make the proper electrical connection to the wire. The cord has three side-by-side wires separated by insulation, the outer two wires being the parallel wires of the circuit and the center wire providing the series connection wires. The center wire is preformed with cutouts for the lampholder locations, and each lampholder cover has a divider fitting into the respective cutout to separate the ends of the center wire exposed at the cutout.

Each contact plate has a center pointed contact finger to engage the center wire. In addition, the lead-in contact plate of the first lampholder in each series set and the lead-out contact plate of the last lampholder in each series set have a second pointed contact finger arranged to engage the appropriate one of the two outer parallel wires so as to make the parallel connection for the series set. The intermediate lampholders in each series set have a pair of contact plates, each with a pointed contact finger to engage the end portion of the center wire sections adjacent to the cutout to make the series connection.

BRIEF DESCRIPTION OF THE DRAWINGS

FIG. 4 is a front elevational view of the lampholder of FIG. 3, showing a hinged cover in the open position.

FIG. 5 is a side elevational view of the lampholder of FIG. 4, showing a contact plate ready for insertion within the lampholder.

FIG. 6 is a top plan view of the lampholder of FIG. 4.

FIG. 7 is a bottom plan view of the lampholder of FIG. 5.

FIG. 8 is a front sectional view of the lampholder of FIG. 4, shown with a lamp and lamp base inserted in the lampholder, with the cover closed and with the contact plates in position and piercing the power cord.

FIG. 9 is a side sectional view of the lampholder of FIG. 8, showing a contact plate with a single contact finger.

FIG. 10 is a side sectional view of the lampholder of FIG. 8, showing a contact plate with two contact fingers.

FIG. 11 is a fragmentary view showing the power cord used with the lampholders of the present invention, with a plug and a socket attached to the respective ends of the cord.

BEST MODE FOR CARRYING OUT THE INVENTION

Figure 1:
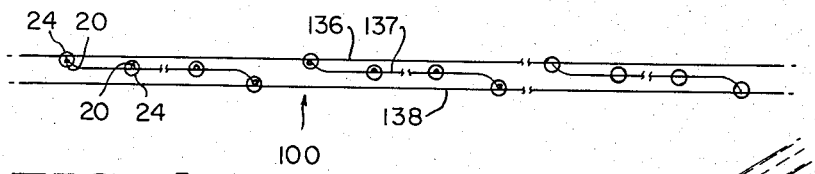
FIG. 1 is a schematic drawing of a seriesparallel light string which is achieved using the present invention.
Figure 3:
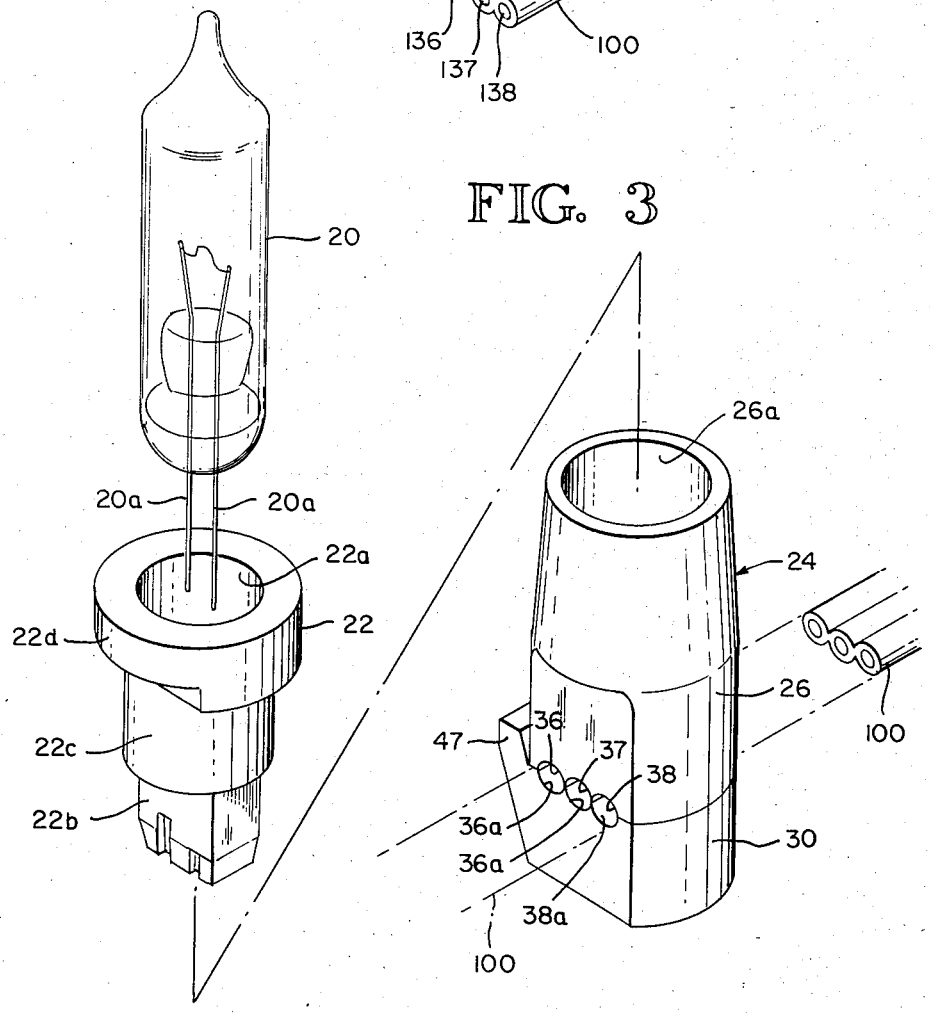
FIG. 3 is an exploded isometric view of a lamp and lamp base insertable in a lampholder of the present invention used in the light string of FIG. 1, with the power cord shown in phantom.

For purposes of illustration, the invention is shown applied to a series-parallel decorative light string, such as shown in FIG. 1. As best shown in FIGS. 3 and 8, each lamp unit of this invention has a miniature push-in type lamp or bulb 20, a lamp base 22 in which the lamp 20 is mounted, and a lampholder 24 receiving the lamp base. The lampholder unit 24 has a husk or housing 26, two conductor plates 28, and a snap-on cover 30 attached to the husk 26 at a base end opposite from the lamp 20.

As is common in the decorative lighting string art, each lamp 20 seats in a socket **22*a* in the lamp base 22 and has a pair of wire leads 20*a* extending therefrom. These leads 20*a* each extend through an open passage from the socket 22*a* of the lamp base 22 and double back over a pair of flat external cheeks 22*b* stepped inwardly from a cylindrical portion 22c surmounted by a gripping rim 22d**.

The lampholder husk 26 has a cylindrical socket portion 26a to receive the cylindrical portion 22c of the lamp base 22, and has a bore extension 26b of reduced cross section extending from the socket portion 26a to the opposite end of the husk. The bore extension 26b has a pair of recessed parallel faces 26c in front of which the conductor plates 28 are situated. To retain the conductor plates 28, the husk 26 is formed with a keeper groove 26d along each of the longitudinal edges of the parallel faces 26c. In large part, the lamp 2, lamp base 22 and lampholder unit 24 thus far described are similar to those shown in U.S. Pat. No. 3,104,924.

The departure from the prior art centers around the manner in which the conductor platets 28 make contact or connection with the wires of the power supply cord. Rather than the wires of the power supply cord entering the husk to engage or connect to the conductor plate elements as shown, for example, in U.S. Pat. Nos. 3,104,924 or 3,286,088, the conductor plates 28 are introduced from the base of the husk 26 and each have pointed insulation-piercing contact fingers projecting from the main body of the plate. As will later be described in more detail, each of the conductor plates 28 has a center contact finger 32, and some also have a second contact finger 34 to one or the other side of the center contact finger.

Referring now to FIGS. 4–7, at the base of the husk 26 the recessed parallel faces 26 are each interrupted by three respective generally semicircular wireway cutouts 36, 37 and 38, as shown in FIG. 5 and 6. The wireway cutouts 36, 37 and 38 are complemented by matching wireway grooves 36a, 37a and 38a in the cover 30. It will be noted, however, that the central wireway cutout 37a in the cover 30 is interrupted by a centrally located divider wall 40.

The cover 30 is preferably molded with the husk 26 and is joined thereto by an integral hinge portion 42 of reduced cross section. On the other side opposite from the hinge 42, the husk 26 is integrally formed with a hasp 44 having a sloped strike face 44a intersecting a keeper face 44b. To interact with the hasp 44, the cover 30 has a cutout 46 with an outer strike face 46a provided by a bridge 47 to engage the strike face 44a of the hasp 44 when the cover is swung into a closed position. The bridge 47 rides over the hasp while the cover 30 is being closed, and there is sufficient flexibility in the parts that the bridge 47 snaps past the tip edge 44c between the hasp faces 44a and 44b and lodges against the keeper face 44b to lock the cover 30 in the closed position. In the closed position, the wireway cutouts 36, 37 and 38 in the husk 26 and the wireway cutouts 36a, 37a and 38a in the cover 30 collectively form a three-sectioned wireway with the center section interrupted by the divider wall 40 of the cover. The wireway has the pointed contact fingers 32 and 34 of the conductor plate elements 28 and 29 projecting therein to pierce the insulation of a three-strand insulated cord 110 positioned with one of the strands in each of the wireway sections.

The keeper grooves 26d in the husk 26 for retaining the contact plates 28 do not extend the full length of the contact plates. Instead, the contact plates are preferably formed with a neck portion 28a to serve as a lead-in portion and provide stop shoulders 28b to engage the inner ends of the grooves 26d and accurately position the contact plates in the husk 26. When mounted in position, the contact plates 28 are in substantially parallel relation and have their center contact fingers 32 on opposite sides of the divider wall 40.

Figure 2:
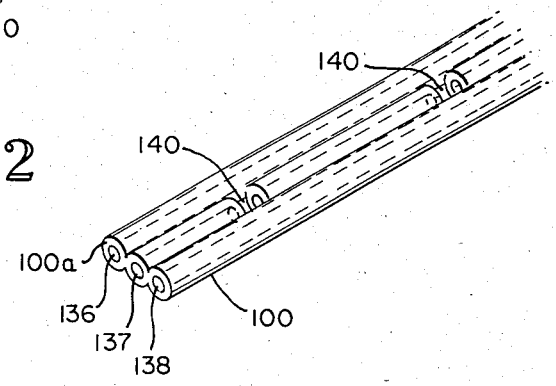
FIG. 2 is an isometric view showing a power cord with cutouts used with the present invention.

As part of the invention, the insulated cord 100 has three wires 136, 137 and 138 arranged in generally coplanar relation as a ribbon and separated by insulation 100a, as shown in FIGS. 2 and 11. The cord 100 has a series of cutouts 140 severing and passing through the center wire 137 and spaced apart along the length of the cord according to the desired spacing of the lampholders 24. The cutouts 140 are formed to receive the divider wall 40. At its ends, the cord 100 is provided with a wall plug 142 and an add-on socket 144. The outer two wires 136 and 138 are electrically connected to the contacts of the plug 142 and socket 144, and the center wire 137 dead-ends within the plug and socket.

The intermediate lampholders 24 in each series set within the string have their contact plates 28 only with the center insulation-piercing contact fingers 32 for making contact with the wire 137, whereas the lampholders at the ends of each series set have their outer contact plate also provided with the outer insulation-piercing contact finger 34 for also making contact with one of the wires 136 or 138.

To assemble a lighting string after the contact plates 28 have been inserted into the husk 26 of the lampholders 24 with the covers 30 in the open position, as shown in FIG. 5, the lampholders are positioned along the cord 100 by inserting the divider walls 40 through the cutouts 140 in the cord. The lampholders 24 and the covers 30 are then swung into the closed position around the cord 100 to close the covers and lock the lampholders on the cord with the cord passing through the wireway of each lampholder. During the closing operation, the pointed contact fingers 32 and 34 are forced through the cord insulation 100a into contact with the correspondingly positioned wire. The divider walls 40 are of an insulating material and are sized to maintain the severed ends of the wire 137 separated and in position in the cord 100 against longitudinal movement.

Commonly, 12-volt bulbs are used, in which case 10 bulbs may be used in each series set of the string, assuming a 120-volt power source. The center eight bulbs in each series set will have the contact plate 28 of the lampholder 24 with only center contact fingers 32, such as shown in FIG. 9. Their circuit will each be from the center wire 137 on each side of the cutout 140 to the bulb 20 via the contact fingers 32, the main body of the contact plates 28, and the wire leads 20a of the bulbs. The first lampholder 24 of each series set will have its outer contact plate 28 with a center contact finger 32 engaging the center wire 137 and an outer contact finger 34 engaging the outer wire 136, as shown in FIG. 10, and will have its inner contact plate with only a center contact finger 32 engaging the center wire 137. Similarly, the last lampholder 24 of each series set will have its inner contact plate 28 with only a center contact finger 32 engaging the center wire 137, and will have its outer contact plate with a center contact finger 32 engaging the center wire 137 and an outer contact finger 34 engaging the outer wire 138. The entire string, made up of several of these series sets, will require only a single continuous cord 100.

Although incandescent light bulbs 20 are shown and described, it will be appreciated that light-emitting diodes (LED) could also be used with the present invention.

I claim:

1. A lighting string comprising:

a plurality of series of lampholders with lights and wireways;

a cord passing through the wireway of each of said lampholders, said cord having three wires separated by insulation and having a respective cutout entirely within the wireway of each lampholder and severing one of said wires, said cutouts being shorter than the wireways, the other two wires being non-severed at the lampholders; and respective contact means in the lampholders piercing the cord insulation and engaging the severed wire, said contact means bridging said cutouts in the severed wire via the lights, the contact means of the first lampholder in each of said series also piercing said cord insulation and making electrical contact with one of the non-severed wires, and the contact means of the last lampholder in each of said series also piercing said cord insulation and making electrical contact with the other of the non-severed wires, whereby said plurality of series of lampholders are connected in parallel.

2. A lighting string according to claim 1 in which each of said lampholders has a divider extending through the respective cutout in the cord, said dividers being shorter than the wireways.

3. A lighting string according to claim 1 in which each of said lampholders has a cover having an open position for insertion of the cord and a closed position engaging the cord.

4. A lighting string according to claim 3 in which each cover has a divider projecting therefrom into the respective cutout in the cord, said dividers being shorter than the wireways.

5. A lighting string according to claim 3 in which each cover is hinged to its lampholder and has a snap fit with the lampholder when in the closed position.

6. A lighting string according to claim 1 in which each of said lampholders has a base portion with three parallel, generally semicircular grooves and a cover for the base portion also having three generally semicircular grooves, the grooves in the base portion and cover collectively defining a wireway for the cord when the cover is in a closed position.

7. A lighting string according to claim 1 in which the center wire of the cord is the severed wire and each lampholder has a divider extending into a respective cutout in the severed wire.

8. A lighting string according to claim 8 in which said contact means for each lampholder comprises a pair of parallel contact plates each having a first projecting cordpiercing portion extending through the cord insulation into electrical contact with the severed wire, and in which the respective contact means for the first and last lampholders in each series has a second projecting cordpiercing portion extending through the cord insulation into electrical contact with one of the non-severed wires.

9. A lighting string according to claim 8 in which each light has a plug-in base fitting between the contact plates of the respective lampholder and pressing wire leads for the light against the contact plates.

10. A lampholder assembly comprising:

a housing having a socket at one end to receive a lamp unit;

a pair of contact members at opposite sides of the socket and having pointed piercing portions at the base of the housing generally opposite the socket; and a cover at the base of the housing having open and closed positions, said cover providing with the housing a covered wireway into which said piercing portions of the contact members project, said cover being hinge-connected to the housing and having a snap fit with the housing when in closed position.

11. A lampholder assembly according to claim 10 in which said cover has a divider projecting into a central portion of the wireway.

12. In a lighting string:

a cord having three wires separated by insulation, said cord having a cutout severing one of said wires;

a lampholder having said cord passing therethrough and having a divider extending through said cutout;

two contact members in the lampholder piercing the insulation of the cord within the confines of the lampholder and making electrical contact with the severed wire on opposite sides of said divider, one of said contact members also making electrical contact with one of the other two of said wires within the confines of the lampholder, the remaining wire of the three wires not having electrical contact with said contact members; and a lamp in the lampholder having operative electrical contact with said contact members.

13. In a lighting string:

a cord having three wires separated by insulation, said cord having two cutouts severing one of said wires at two respective locations;

two lampholders having said cord passing therethrough and each having a divider extending through a respective one of said cutouts;

two respective contact members in each of the lampholders piercing the insulation of the cord and making electrical contact with the severed wires on opposite sides of the respective divider;

one of the contact members of one of the lampholders also making electrical contact within the lampholder with one of the non-severed wires, and one of the contact members of the other of the lampholders also making electrical contact within the lampholder with the other of the non-severed wires; and a light socket in each of the lampholders having operative electrical contact with the contact members of the respective lampholder.

14. In a lighting string according to claim 13 in which said cord has a series of additional cutouts through the severed wire between said two cutouts and has a series of lampholders located at respective ones of said series of cutouts, said series of lampholders each having contact members making electrical contact with the severed cord at opposite sides of the respective cutouts in the same manner as the contact members of said two lampholders except that the contact members of said series of lampholders do not make electrical contact with the two non-severed wires.

15. In a lighting string:

a plurality of lampholders each having wireway therethrough;

a cord extending through the wireways and having three wires separated by insulation;

a series of cutouts in the cord severing one of the three wires; and a divider in each wireway extending into one of said cutouts.

16. A lampholder assembly comprising:

a housing having a socket at one end to receive a lamp unit;

a pair of contact members at opposite sides of the socket to engage the lamp unit and having pointed piercing portions at the base of the housing generally opposite the socket; and a cover at the base of the housing collectively providing with the housing a covered wireway into which said piercing portions of the contact members project, said wireway having three generally circular, coplanar portions and the central portion being interrupted by a divider shorter than the length of the wireway, said contact members having piercing portions projecting into said central portion at opposite ends thereof from said divider.

17. A lampholder assembly comprising:

a one-piece housing having a socket at one end to receive a lamp unit and a base at the opposite end;

a wireway at said base;

a pair of contact members in the housing and exposed to the socket, said contact members having pointed piercing portions projecting into said wireway;

a one-piece cover having a cutout at one end closed at said one end by a bridge portion of the cover, said cover being hinge-connected at its opposite end to said housing by a hinge which is integral with the housing and cover and is offset to one side of the housing base, said cover having an open position whereat the cover projects away from the housing and a closed position whereat the cover overlies the housing base and wireway; and a hasp projecting integrally from the housing base oppositely from said hinge and arranged to occupy said cutout when the cover is in closed position, said bridge having a snap fit with said hasp when the cover is substantially in closed position.

18. A lampholder assembly according to claim 17 in which said hasp has a strike face which slopes outwardly away from the base of the housing and intersects a keeper face on the hasp which is engaged by the bridge when the cover is in its closed position, said bridge having a strike face arranged to engage the strike face on the hasp as the cover approaches its closed position, there being sufficient flexibility in the hasp and cover to permit the bridge to snap past the juncture of the strike face and keeper face of the hasp as the cover is closed.

19. A lighting string comprising:

a plurality of series of lampholders with lights;

two continuous insulated wires passing into and out of each of said lampholders, and a third insulated wire having interrupted sections located entirely within the lampholders; and respective contact means in the lampholders bridging said interrupted sections in the third wire via the lights, the contact means of the first lampholder in each of said series also making electrical contact with one of the two continuous wires, and the contact means of the last lampholder in each of said series also making electrical contact with the other of the two continuous wires, whereby said plurality of series of lampholders are connected in parallel.

20. A lighting string according to claim 19 in which each of said lampholders has an integral hinged cover having an open position for insertion of the three wires and a closed position enginging the three wires, said cover having a divider projecting therefrom into the respective interrupted section in the third wire.

21. A lampholder assembly comprising:

a housing having a socket at one end to receive a lamp unit;

a pair of contact members at opposite sides of the socket and having pointed piercing portions at the base of the housing generally opposite the socket;

a cover at the base of the housing having open and closed positions, said cover providing with the housing a covered wireway into which said piercing portions of the contact members project and having a divider projecting into a central portion of the wireway; and said cover being hinge-connected to the housing at one side of the wireway and having a snap fit with the housing at the other side of the housing when in closed position.

* * * * *